United States Patent [19]

Emmerich et al.

[11] Patent Number: 4,907,648

[45] Date of Patent: Mar. 13, 1990

[54] PLASTIC CROSSCURRENT HEAT EXCHANGER

[75] Inventors: Friedel Emmerich, Seeheim-Jugenheim; Dieter Franitza, Darmstadt; Heinrich Hartmann, Reichelsheim; Klaus Kerk, Griesheim, all of Fed. Rep. of Germany

[73] Assignee: Rohm GmbH Chemische Fabrik, Darmstadt, Fed. Rep. of Germany

[21] Appl. No.: 264,849

[22] Filed: Oct. 31, 1988

[30] Foreign Application Priority Data

Nov. 2, 1987 [DE] Fed. Rep. of Germany ..... 8714559

[51] Int. Cl.[4] ..... F28F 3/10

[52] U.S. Cl. ..... 165/166; 165/165

[58] Field of Search ..... 165/166

[56] References Cited

U.S. PATENT DOCUMENTS

| | | | |
|---|---|---|---|
| 1,409,967 | 3/1922 | Prat | 165/166 |
| 2,310,121 | 2/1943 | Scherer | 165/166 X |
| 2,953,110 | 9/1960 | Etheridge | 165/166 X |
| 2,959,401 | 11/1960 | Burton | 165/166 |
| 3,274,672 | 9/1966 | Dore | 29/157.3 |
| 4,733,718 | 3/1988 | Schikowsky et al. | 165/4 |

FOREIGN PATENT DOCUMENTS

| | | |
|---|---|---|
| 44561 | 1/1982 | European Pat. Off. . |
| 2751115 | 5/1979 | Fed. Rep. of Germany . |
| 3137296 | 4/1983 | Fed. Rep. of Germany . |
| 2318398 | 2/1977 | France . |
| 2449261 | 9/1980 | France . |

OTHER PUBLICATIONS

C. M. Berger et al., "Crossflow Heat Exchanger", IBM Tech. Discl. Bulletin, vol. 13, #10, Mar. 1971, p. 3011.

*Primary Examiner*—Martin P. Schwadron
*Assistant Examiner*—Allen J. Flanigan
*Attorney, Agent, or Firm*—Oblon, Spivak, McClelland, Maier & Neustadt

[57] ABSTRACT

A crosscurrent heat exchanger body made up of a stack of joined, parallel flow web plates (1), and a hollow chamber (5) for flow across them between each two successive web plates, with the cover layers (2,2') of successive web plates being sloped toward one another at their ends over the hollow chamber (5) enclosed between them, and being joined tightly to one another over the entire width, is disclosed.

5 Claims, 1 Drawing Sheet

PLASTIC CROSSCURRENT HEAT EXCHANGER

BACKGROUND OF THE INVENTION

1. Field of the Invention

This invention concerns a plastic crosscurrent heat exchanger body that is composed of a stack of extruded web plates and serves to exchange heat between flowing media. In contrast to a complete heat exchanger, including the supply and discharge lines for the flowing media in addition to the necessary collecting tanks, the term "heat exchanger body" herein is meant to imply only the arrangement of flow channels between which heat is transferred.

2. Discussion of the Related Art

Although plastics are generally poorer heat conductors than metals, plastic heat exchangers have attained considerable importance for applications involving a simple and inexpensive method of production and low material costs, which were not achievable with metal heat exchangers. The lower weight can also be crucial for the selection of plastic as the material for heat exchangers.

In any case, the economy of large heat exchanger systems, such as those used in dry-cooling towers or waste gas desulfurization systems, is critically affected by the expense of producing the heat exchanger body.

Extruded plastic web plates consisting of two planar, parallel cover layers and webs coextruded integrally with the cover layers located between them, which enclose parallel hollow flow chambers, are outstanding structural elements for heat exchanger bodies because of their low costs of production. According to DE-A No. 27 51 115, plastic web plates are cemented into a stack by means of an adhesive applied to the cover layers. According to EP-B No. 167 938, the stacked web plates in such an arrangement are connected to one another only in the facial area to simplify the production process, for example, by means of an intermediate hot wire that is heated above the melting point of the plastic by applying an electrical voltage, and leads to the welding of the adjacent plastic surfaces.

Crosscurrent heat exchanger bodies that are composed of extruded plastic web plates and contain a hollow flow chamber across them between each two parallel flow web plates, are also known from FR-A No. 2 469 684 and DE-A No. 31 37 296. In both cases, the web plates have a uniform profile up to their faces. None of these publications describe a joining technique that permits rapid and simple construction of a heat exchanger body from a number of web plates. A drawback of the known heat exchanger bodies is the unfavorable flow impact profile of the open faces.

In spite of the above approaches, there has remained a need for heat exchangers which are simpler, less expensive to produce, than metal heat exchangers.

SUMMARY OF THE INVENTION

The purpose of this invention was to provide a crosscurrent heat exchanger body consisting of a stack of extruded plastic web plates, that has an advantageous flow impact profile and can be produced simply and reliably.

This goal is reached with the crosscurrent heat exchanger body described herein.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
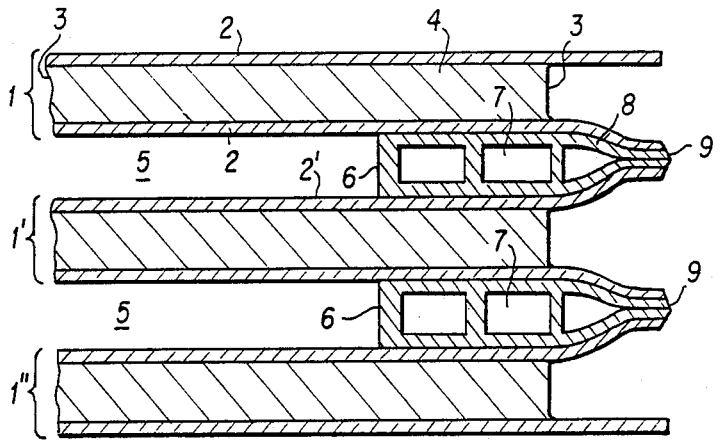
FIG. 1 shows a cross-section of the boundary area of a crosscurrent heat exchanger body according to the present invention, with a stack of only three web plates being shown for clarity.

Referring to FIG. 1, the hollow chambers 4 in all of the web plates 1 are in parallel alignment and are open at the face ends, and therefore permit flow in the direction of extrusion of the web plates. On the other hand, the hollow chambers 5 enclosed by the web plates 1 are sealed at the faces of the web plates and are open at the ends of the heat exchanger body at which the web plates are sealed by their marginal webs, and therefore permit flow across the hollow chambers 4.

The sloping and connecting of the cover layers at the faces of the web plates 1 leads to funnel-shaped openings of the hollow chambers 4. This achieves a favorable flow impact profile for the inflowing medium with low flow resistance. A crosscurrent heat exchanger with beneficial characteristics is obtained by connecting collecting tanks and supply and discharge lines for the flowing media at all four sides of the generally rectangular heat exchanger body. From the viewpoint of economy, the simple production of the new heat exchanger bodies is a decisive advantage over the known designs.

The web plates used for the construction of the heat exchanger body are produced from thermoplastics by extrusion. The plastic must be resistant to the flowing media and must have a softening point above the highest operating temperature. As long as these requirements are met, any extrudable plastics can be used, for example polyethylene, polypropylene, polyvinyl chloride, polystyrene, or polymethyl methacrylate. Polycarbonate and polysulfone plastics are useful for operating temperatures above 100° to approximately 120° C. Polyphenylene oxides, polyether imides, or polyether sulfones, for example, can be used for operating temperatures up to 150° C.

Suitable dimensions of the web plates are a length of 500 to 3000 mm, a width of 300 to 2000 mm, and a thickness of 3 to 30 mm, but these dimensions are not critical. The cover layers 2 and the webs 3 can have a thickness, generally about the same, of 0.5 to 5 mm, corresponding to the static requirements at the operating temperature. The hollow chambers 4 are bounded by the webs 3 and the sections of the cover layers 2 between them. The webs can be perpendicular to the cover layers or at an angle to them. The heat transfer between the flowing medium and the web plate is improved if turbulent flow is provided for by a suitable geometry of the cross section of the hollow chamber. This can also be assisted by corrugating the webs in the longitudinal direction. Processes for producing web plates with corrugated webs are known.

The heat exchanger body generally consists of more than 2, preferably 5 to 100 web plates 1 connected to one another in a stack. Their cover layers 2, 2', at least to the extent that they define hollow chambers 5, are sloped toward one another at the face ends over the hollow chambers between them and are joined tightly to one another over the entire width of the web plates. The area in which the cover layers are inclined can extend over a length of one to two times the thickness of the web plate, for example. Preferably, the webs 3 are cut out to this depth, and in particular they are milled out. If this is not the case, they have to have a height increasing toward the end following the slope of the cover layers, which can be achieved by stretching in the thermoelastic state concurrently with the forming of the cover layers. The slope of two cover layers 2, 2' defining a hollow chamber 5 is generally the same, so that they meet in the central plane of the hollow chamber 5 and are joined tightly there. The thickness of the hollow chambers 5 is determined by the slope of the cover layers. This thickness is suitably about the same as that of the hollow chambers 4 within the web plates 1, but the ratio of these thicknesses can be within a rather broad range from approximately 1:3 to 3:1.

The joining of the ends of the cover layers 2, 2' sloped toward one another should be so tight that passage of the media flowing through the hollow chambers is largely or completely suppressed in both directions. A tight connection is achieved by clamped-on U-profiles, by cementing, or preferably by welding to form a welded seam 9.

If the hollow chambers 5 are sealed off only by the inclined and joined ends of the cover layers 2, 2', the heat exchanger body does not have sufficient strength for all purposes. To improve the strength and rigidity, spacers 6 of the thickness of the hollow chambers are preferably placed in the hollow chambers 5 and support the cover layers 2, 2' resting against them. Preferably, the spacers 6 are positioned parallel to the faces of the web plates throughout, near the sloped ends. They can contain hollow chambers 7 that can also carry flow perpendicular to the direction of extrusion of the web plates, like the hollow chambers 5. It is beneficial for the spacers 6 to have lateral extensions 8, with which they extend into the joint of the cover layers and are likewise joined to them. Preferably, the sloped ends of the cover layers 2, 2' and the extensions 8 of the spacers together form the welded seam 9. Although the spacers can consist basically of any suitable material with adequate compressive strength, they preferably consist of the same plastic as the web plates 1. They can be produced by extrusion, including the lateral extensions 8. If the heat exchanger body has a considerably length, it may be advisable to place other spacers at one or more positions between the faces of the web plates to increase its rigidity and compressive strength. It is likewise possible to use web plates that essentially fill up the hollow chambers 5, as spacers. They can be joined to one another at the ends extending out of the heat exchanger in the same way as the web plates 1, and are then distinguished by equally good flow impact characteristics.

The new heat exchanger bodies can be produced in a simple manner. For this purpose, all of the web plates 1 are cut off to size at the same desired length, and their webs are cut away to the depth of the necessary forming. The web plates whose cover layers are not sloped at their faces are stacked with a separation that corresponds to the desired thickness of the hollow chambers, so that their faces lie in a plane. this is preferably done by inserting a spacer 6 at the face of each web plate. The face ends of the cover layers 2, 2' are heated by applying continuous heated welding heads until the softening point of the plastic is reached, and then pressing them together in pairs by closing the welding heads. If spacers 6 with extensions 8 are also used, they are heated at the same time and also formed, if necessary. If it is intended to make a joint with slip-on profiles or by adhesive, the formed ends of the web plates can be allowed to cool in this position, and they are then joined. Preferably, the formed ends of the cover layers and the extensions of the spacers 6, if applicable, are heated to the melting point in the contact area, and a welded seam 9 is formed.

The profile of the welding heads should be such that it has a forming effect on the ends of the cover layers 2 and 2' and promotes the development of funnel-shaped inlets into the hollow chambers 4 with a desirable flow impact profile. Preferably, the welding heads have semicircular or half-oval-shaped profile. If web plates are used in which the webs are not cut away to the depth of the desired forming, comb-like welding heads are used that engage into the ends of the hollow chambers 4 and likewise heat the webs 3 to the softening point.

When the welding seam 9 has been formed, the welding heads can be taken away. As a rule, it is not necessary to allow the welded seam to cool together with the welding heads. This produces a high working rate.

Obviously, numerous modifications and variations of the present invention are possible in light of the above teachings. It is therefore to be understood that within the scope of the appended claims, the invention may be practiced otherwise than as specifically described herein.

What is claimed is:

1. A crosscurrent heat exchanger body, which comprises:

a stack of joined plastic flow web plates (1), consisting of two planar, parallel cover plates (2) and parallel webs (3) joined integrally to said cover plates, which enclose parallel hollow flow chambers (4), with a number of web plates being arranged in a stack so that their hollow chambers can carry flow in parallel, and so that a hollow cross-flow chamber (5) is located between each of two such web plates in succession in the stack, wherein the cover layers (2, 2') of each two web plates that are adjacent to a cross-flow hollow chamber (5) are sloped toward one another at their ends across the hollow chamber (5) between them, and are joined to one another over the entire width, and wherein said hollow cross-flow chambers (5) contain spacers (6) of the thickness of the hollow chambers, said spacers (6) containing hollow cross-flow chambers (7).

2. The crosscurrent heat exchanger body according to claim 1, wherein at least some of the spacers (6) have lateral extensions (8) that extend into the joint of the cover layers (2, 2') and are likewise joined to them.

3. The crosscurrent heat exchanger body according to claim 1, wherein the webs are cut away in the end area of the web plates (2) at least to the depth at which the cover layers are sloped.

4. The crosscurrent heat exchanger body according to claim 1, wherein the cover layers (2, 2') are joined by a welded seam (9).

5. The crosscurrent heat exchanger body according to claim 1, wherein the spacers (6) with cross-flow through hollow chambers (7) substantially fill the hollow chambers (5) and are shaped at their ends extending laterally out of the stack in the same way as the web plates (1), and successive spacers are joined to one another.

* * * * *